US005695233A

United States Patent [19]

Feldman

[11] Patent Number: 5,695,233

[45] Date of Patent: Dec. 9, 1997

[54] NOTEBOOK CARRIER DEVICE

[76] Inventor: Rhoda M. Feldman, 2200 Leavenworth St., San Francisco, Calif. 94133

[21] Appl. No.: 624,710

[22] Filed: Mar. 26, 1996

[51] Int. Cl.[6] ..... B42D 3/12

[52] U.S. Cl. ..... 294/138; 294/145; 402/4; 402/79

[58] Field of Search ..... 294/137, 138, 294/145; 402/4, 79, 80 R, 80 L; 281/33

[56] References Cited

U.S. PATENT DOCUMENTS

| | | | |
|---|---|---|---|
| 782,773 | 2/1905 | Bohn . | |
| 1,121,566 | 12/1914 | McKee . | |
| 2,244,246 | 6/1941 | Esterly | 281/20 |
| 2,683,478 | 7/1954 | Seelig | 150/33 |
| 3,156,389 | 11/1964 | Walker, Jr. | 224/46 |
| 3,620,553 | 11/1971 | Donovan | 402/79 |
| 4,098,443 | 7/1978 | Coen et al. | 224/45 |
| 4,577,889 | 3/1986 | Schulz | 402/79 |
| 4,756,556 | 7/1988 | Ader et al. | 281/15 |
| 5,042,841 | 8/1991 | Friedman | 402/79 |
| 5,104,167 | 4/1992 | Nemeth | 294/137 |

*Primary Examiner*—Dean Kramer
*Attorney, Agent, or Firm*—Limbach & Limbach L.L.P.

[57] ABSTRACT

A notebook carrier device that includes a first and a second panel foldably connected together at a fold line. A first and a second set of holes are formed adjacent to the fold line on the first and second panels respectively. The first and second sets of holes oppose each other when the first and second panels are folded together about the fold line. A first and a second handle are attached to the first and second panels respectively. The holes are positioned to be engaged by the rings of a loose-leaf notebook such that the notebook can be conveniently carried by the handles.

16 Claims, 8 Drawing Sheets

NOTEBOOK CARRIER DEVICE

FIELD OF THE INVENTION

The present invention relates to loose-leaf notebooks, and more particularly to a carrier device for carrying loose-leaf notebooks.

BACKGROUND OF THE INVENTION

Loose-leaf notebooks typically secure papers therein by engaging rings through holes formed along one edge of the sheets of paper. Loose-leaf clasping ring notebooks have rings that open and close so that loose-leaf sheets of paper can be added or removed from the rings of the notebook without destroying the holes formed in the paper. Typically, these types of notebooks have two or more rings or posts mounted on a spine, with front and rear covers attached to the spine. Spiral notebooks and fixed ring notebooks typically have a continuous spiral ring or a set of connected fixed rings that are installed by the notebook manufacturer to permanently engage with holes formed in the edge of the sheets of paper carried within.

One drawback to loose-leaf notebooks is that there is no convenient way to carry them. The user must hold the notebook either under an arm or grasped by the hand in such a way as to keep the covers closed. Carrying a notebook in this manner usually prevents the user from using his/her hands for other purposes, such as carrying other objects, opening doors, etc, and can be quite cumbersome for those users that continuously carry notebooks, such as day-planners, with them wherever they go. Further, it can be fatiguing to carry a notebook that is thick and heavy with numerous pages contained therein.

Another drawback to loose-leaf notebooks is that they do not provide a place to store small items, such as keys, tissues, money, business and credit cards, identification, make-up, craft items, etc. For day-planner notebooks, it would be very beneficial to somehow store these items inside the notebook covers in a place having easy but safe access.

There is a need for a simple, inexpensive carrying device for carrying a loose-leaf notebook. There is also a need for such a device to provide a means for storing small items within the notebook.

SUMMARY OF THE INVENTION

The present invention solves the aforementioned problems by providing a simple, inexpensive carrying device that allows the user to carry a loose-leaf notebook by one or more handles in similar fashion to a briefcase, handbag, or over-the-shoulder bag. The carrier device also provides a storage pocket within the notebook.

The notebook carrier device of the present invention includes a first and a second panel foldably connected at a fold line. A first and a second set of holes are formed adjacent to the fold line on the first and second panels respectively. The first and second sets of holes oppose each other when the first and second panels are folded together about the fold line. A first and a second handle are attached to the first and second panels respectively.

In another aspect of the present invention, the notebook carrier device includes a pouch with a top opening and a bottom edge. A plurality of holes are formed in the pouch adjacent the bottom edge. The plurality of holes are positioned to engage the rings of a notebook. A handle is attached to the pouch that extends beyond the covers of the notebook.

Other objects and features of the present invention will become apparent by a review of the specification, claims and appended figures.

DETAILED DESCRIPTION OF THE PREFERRED EMBODIMENTS

Figure 1A:
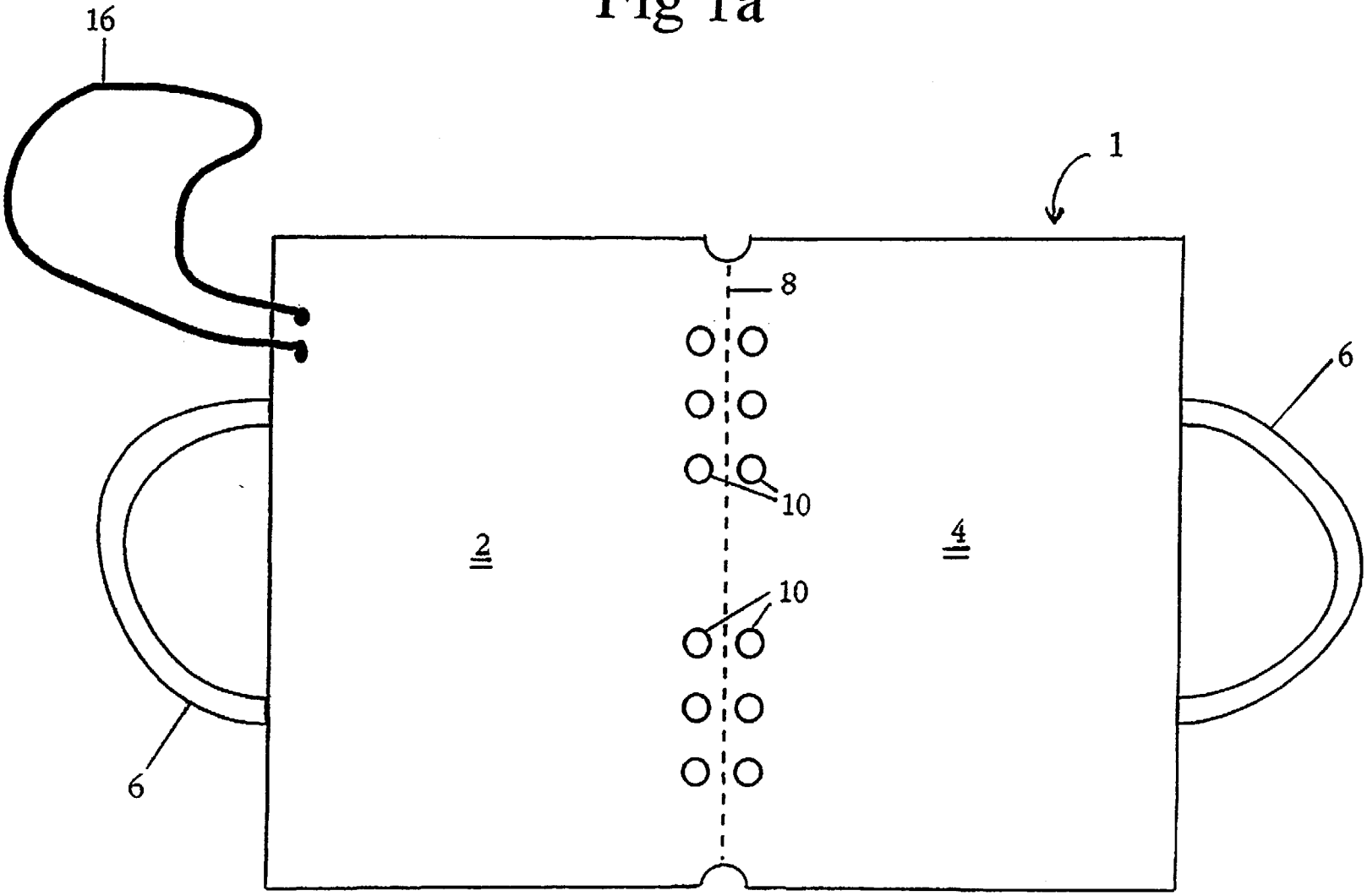
FIG. 1*a* is a top view of the notebook carrying device of the present invention in its unfolded position.
Figure 1B:
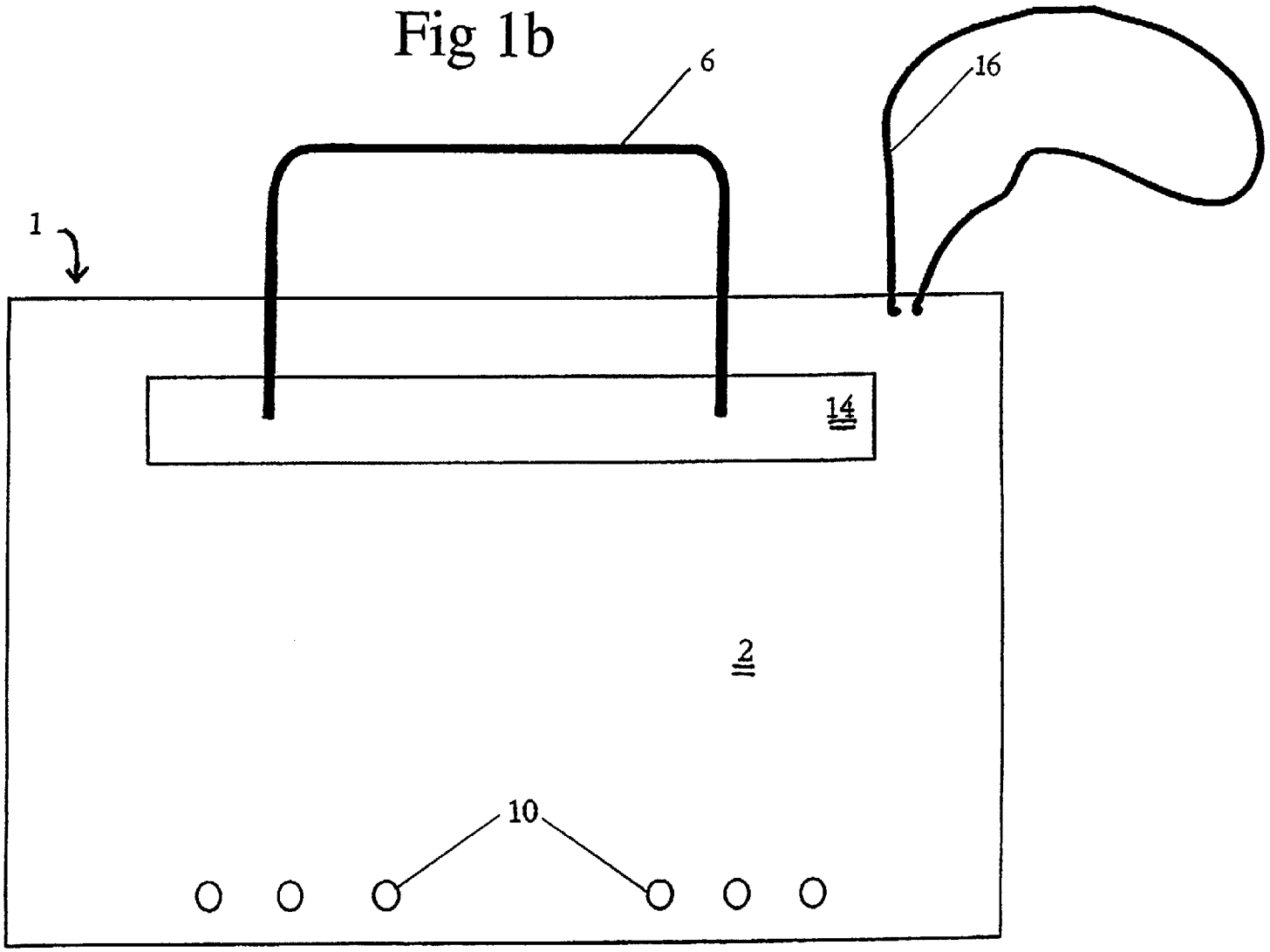
FIG. 1*b* is a side view of the notebook carrying device of the present invention in its folded position.

The present invention is a carrying device that attaches to the rings of a loose-leaf notebook. The carrying device 1 of the present invention is illustrated in FIGS. 1*a* and 1*b*, and includes panels 2 and 4, and handles 6.

Panels 2 and 4 are formed as a single sheet folded at a fold line 8. Alternately, panels 2 and 4 can be separate sheets that are foldably attached to each other at fold line 8. A plurality of holes 10 are formed on each of the panels 2 and 4 adjacent fold line 8. The holes on panel 2 are positioned to oppose the holes on panel 4 when panels 2 and 4 are folded together along fold line 8.

A pair of handles 6 are attached to panels 2 and 4 by a strip of sheet material 14 that is attached to panels 2/4 with an adhesive. Alternately, connection of handles 6 to panels 2/4 can be accomplished by using adhesives, stitching, heat sealing, grommets, or even forming handles 6 integrally with panels 2/4. The length of handles 6 can be made short for grasping by the hand, or longer for placing over one's shoulder. While the carrying device works best with two handles, it can also be made with a single handle attached or formed on just one of the panels 2.

An expandable band 16 has both its ends attached to one of the panels 2/4 by an adhesive, adhesive tape, staples, clips and grommets, or other conventional connection means. The band 16 forms an expandable loop that is used to keep the notebook closed.

Figure 2A:
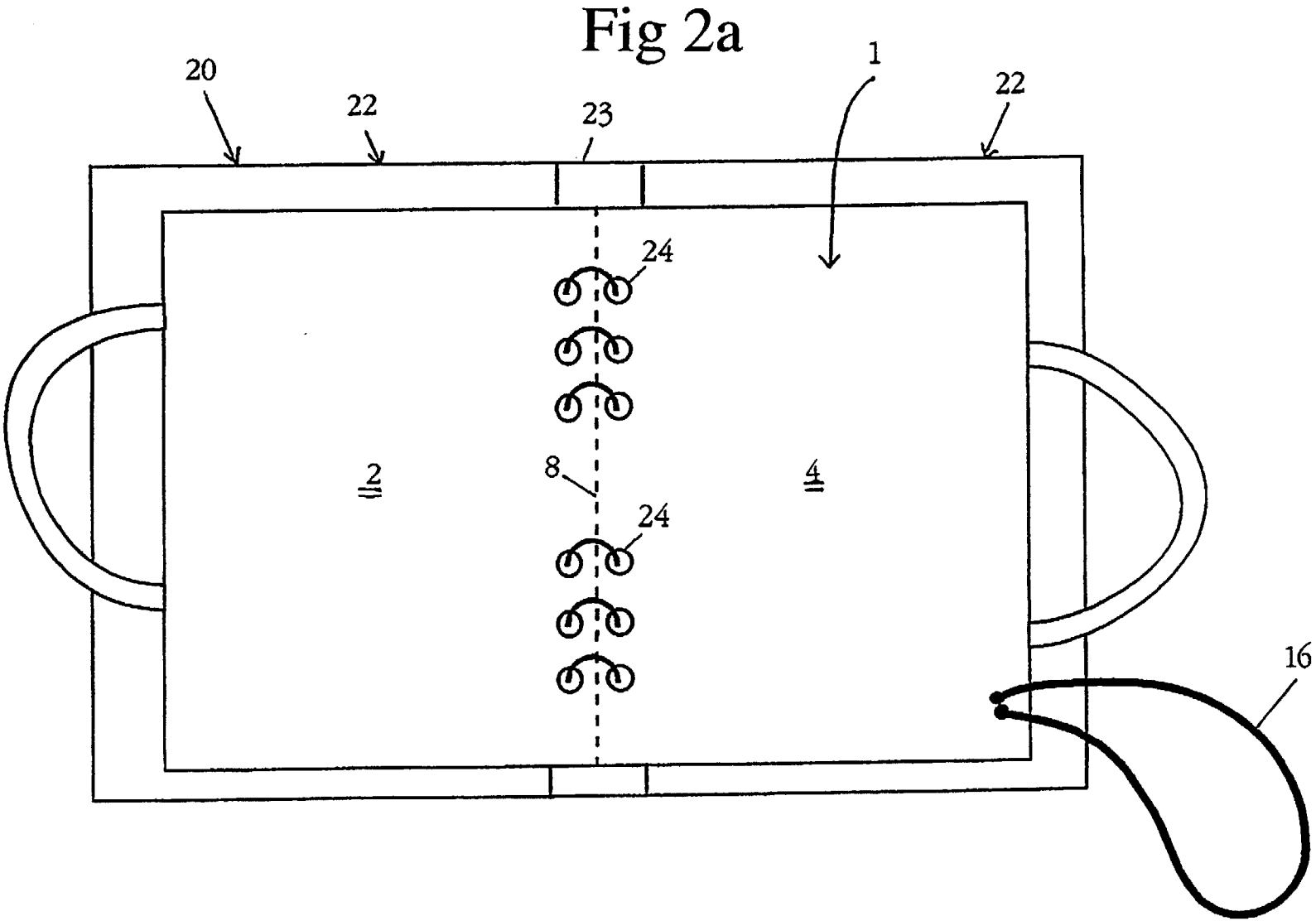
FIG. 2*a* is a top view of the notebook carrying device positioned inside a notebook.
Figure 2B:
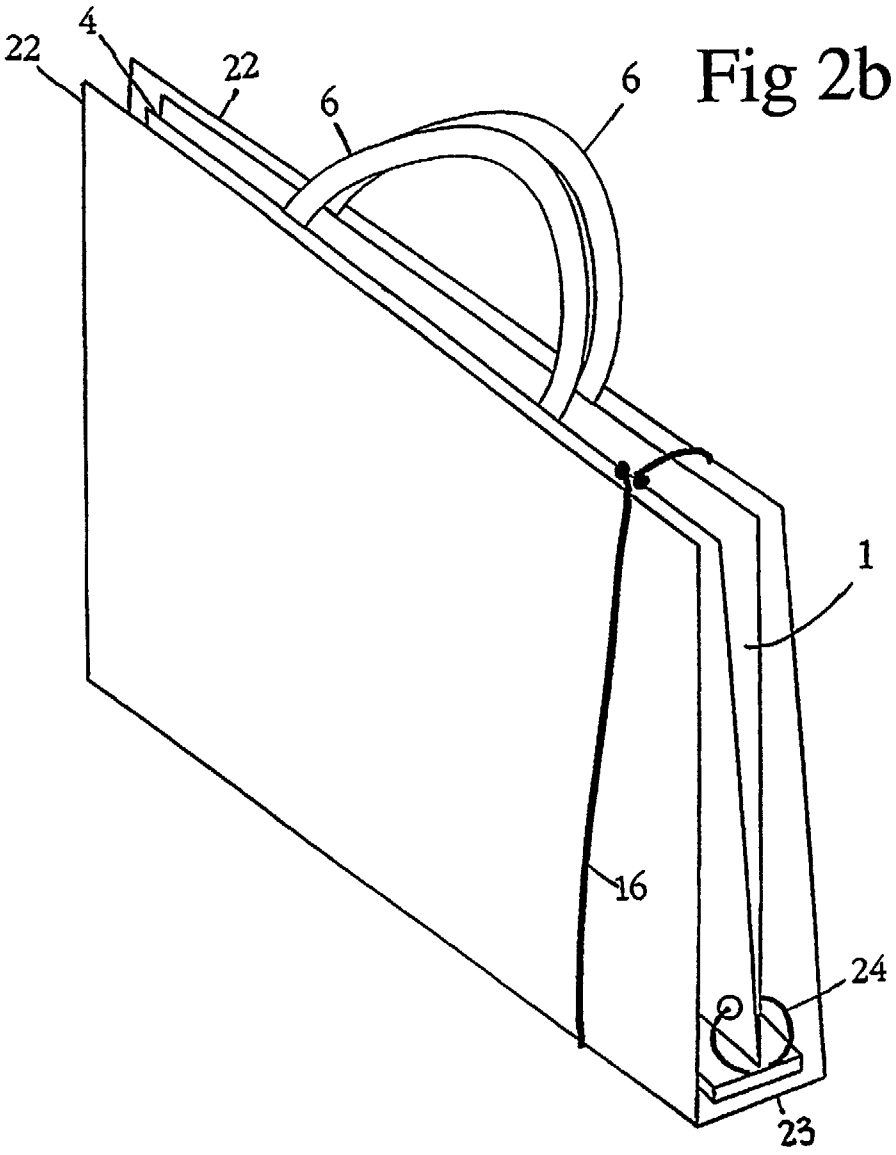
FIG. 2*b* is a perspective view of the notebook carrying device positioned inside a closed notebook.

The carrying device 1 attaches inside a notebook 20 as illustrated in FIG. 2*a*. The notebook includes covers 22 and spine 23 on which clasping rings 24 are mounted. The carrying device is inserted into notebook 20 such that rings 24 clasp around and engage holes 10. When the covers 22 of notebook 20 are closed together, handles 6 extend out from the covers 22, as illustrated in FIG. 2*b*. Band 16 is then wrapped around both covers 22 to keep them in their closed position, such that the user can carry the notebook 20 like a briefcase simply by grasping handles 6. If the notebook 20 has an external means for keeping the covers 22 closed, such as a clasp (not shown), then the band 16 can be omitted.

Figure 3:
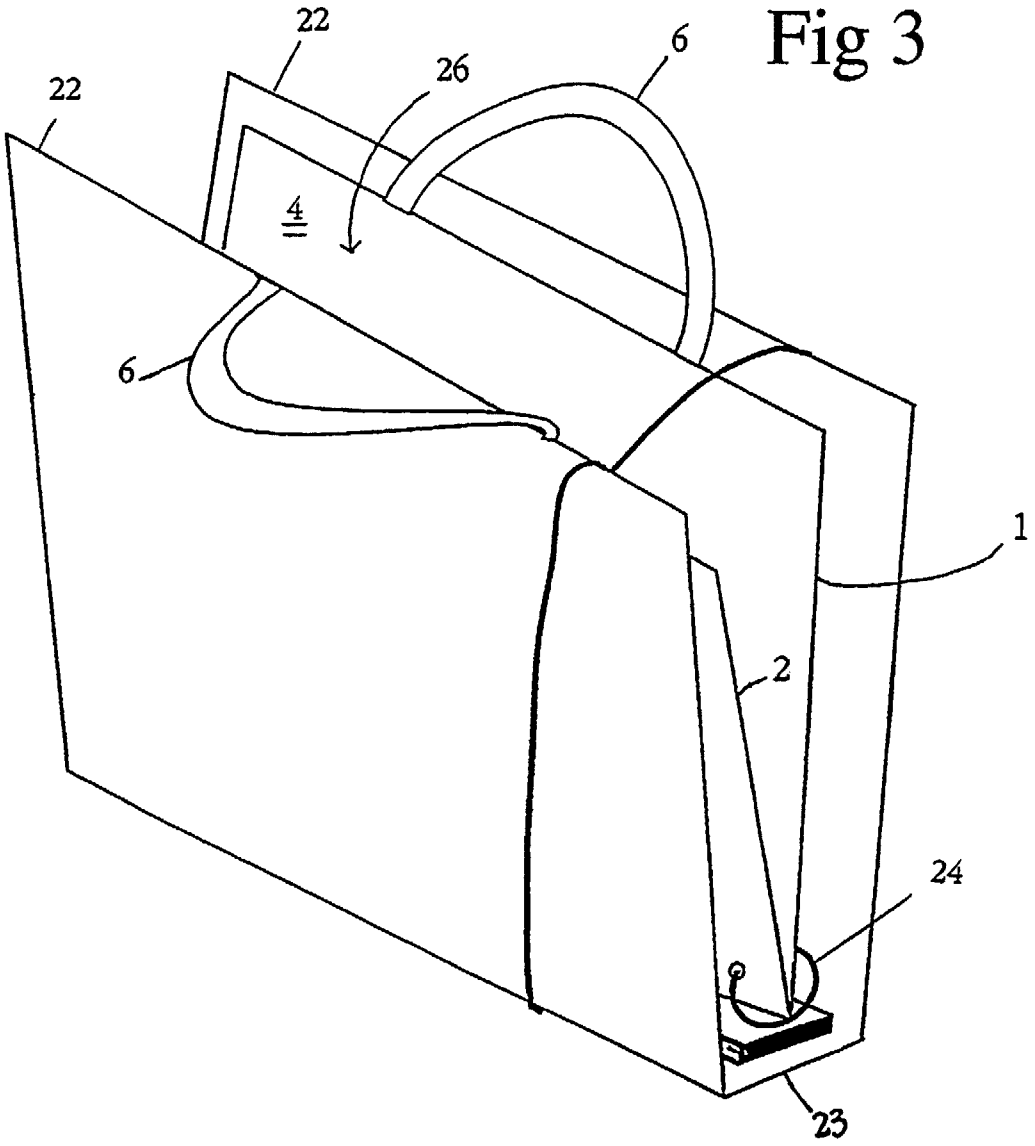
FIG. 3 is a perspective view of the notebook carrying device positioned inside a partially opened notebook.

When the notebook 20 is closed, panels 2 and 4 form an open ended pocket 26 therebetween in which the user can store personal items, such as keys, money, identification, etc. To access the pocket 26, panels 2 and 4 are separated by pulling them apart against the elastic force of band 16 by either using one's fingers or by pulling apart handles 6, as illustrated in FIG. 3. Therefore, the pocket 26 can be easily accessed without removing the band 16 around covers 22. When the notebook 20 is closed again, the elastic force of the band 16 securely holds any items in pocket 26 between panels 2 and 4.

The shape of panels 2/4 can vary from the rectangular shape and size shown in the figures. For example, the panels 2/4 can be square or oval shaped. The size of panels 2/4 can be reduced to merely provide enough space to form holes 10 and attach handles 6, or enlarged so that panels 2/4 extend beyond covers 22 of notebook 20.

The carrying device 1 can be placed anywhere among the other sheets of papers clasped by rings 24. The carrying device can serve as a marker or divider for sheets of paper in notebook 20. In addition, the carrier device 1 can be placed within the other sheets of paper to balance the notebook 20.

Figure 4:
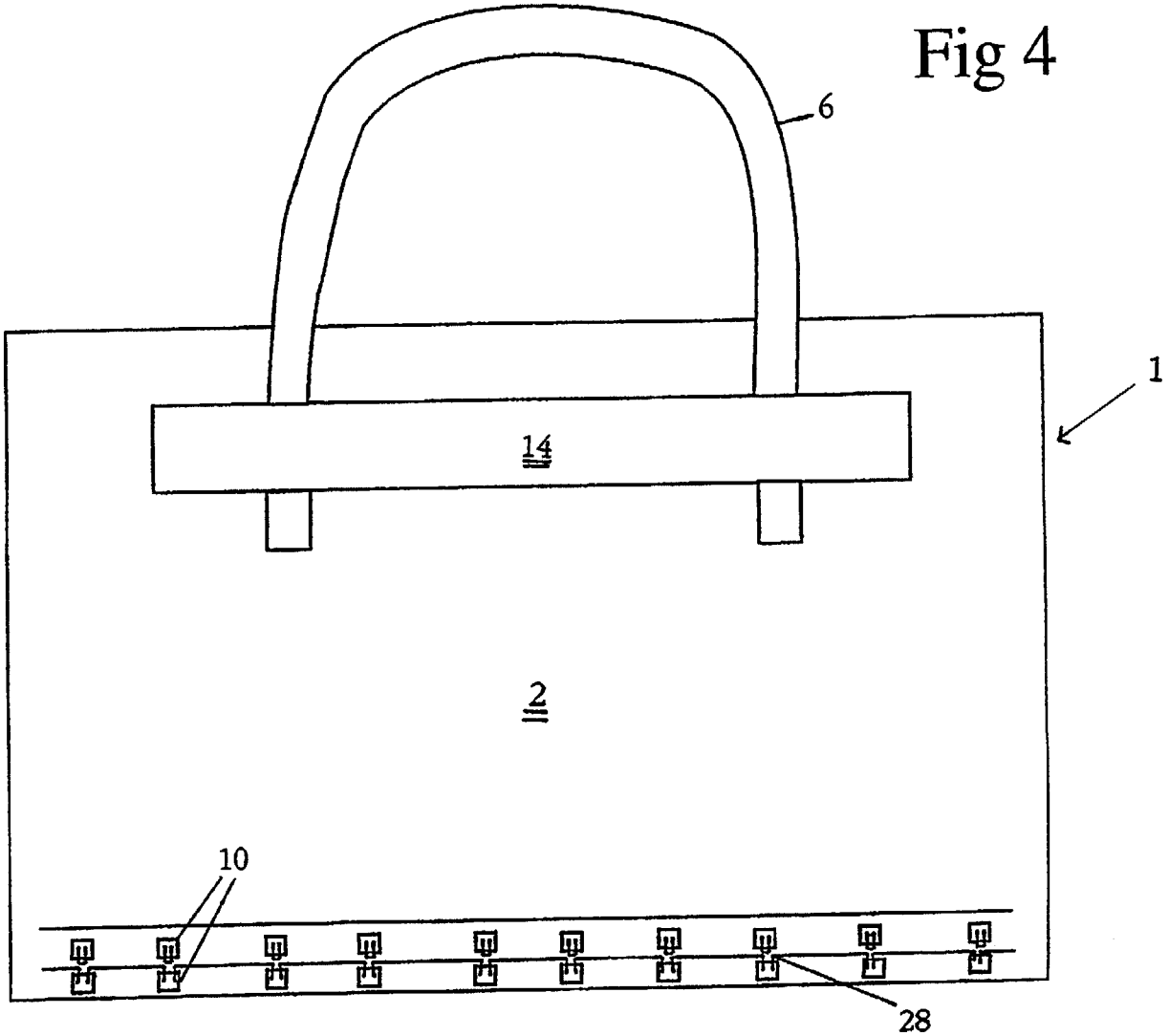
FIG. 4 is a side view of the notebook carrying device for a fixed ring notebook.

FIG. 4 illustrates the carrying device 1 as used in a fixed ring notebook, which permanently fixes the carrying device 1 therein using fixed rings 28 that are connected together. The manufacturer of the fixed ring notebook installs the carrying device 1 along with the rest of the pages so that holes 10 are engaged by the fixed rings 28. Spiral notebooks are also assembled in this manner.

Figure 5:
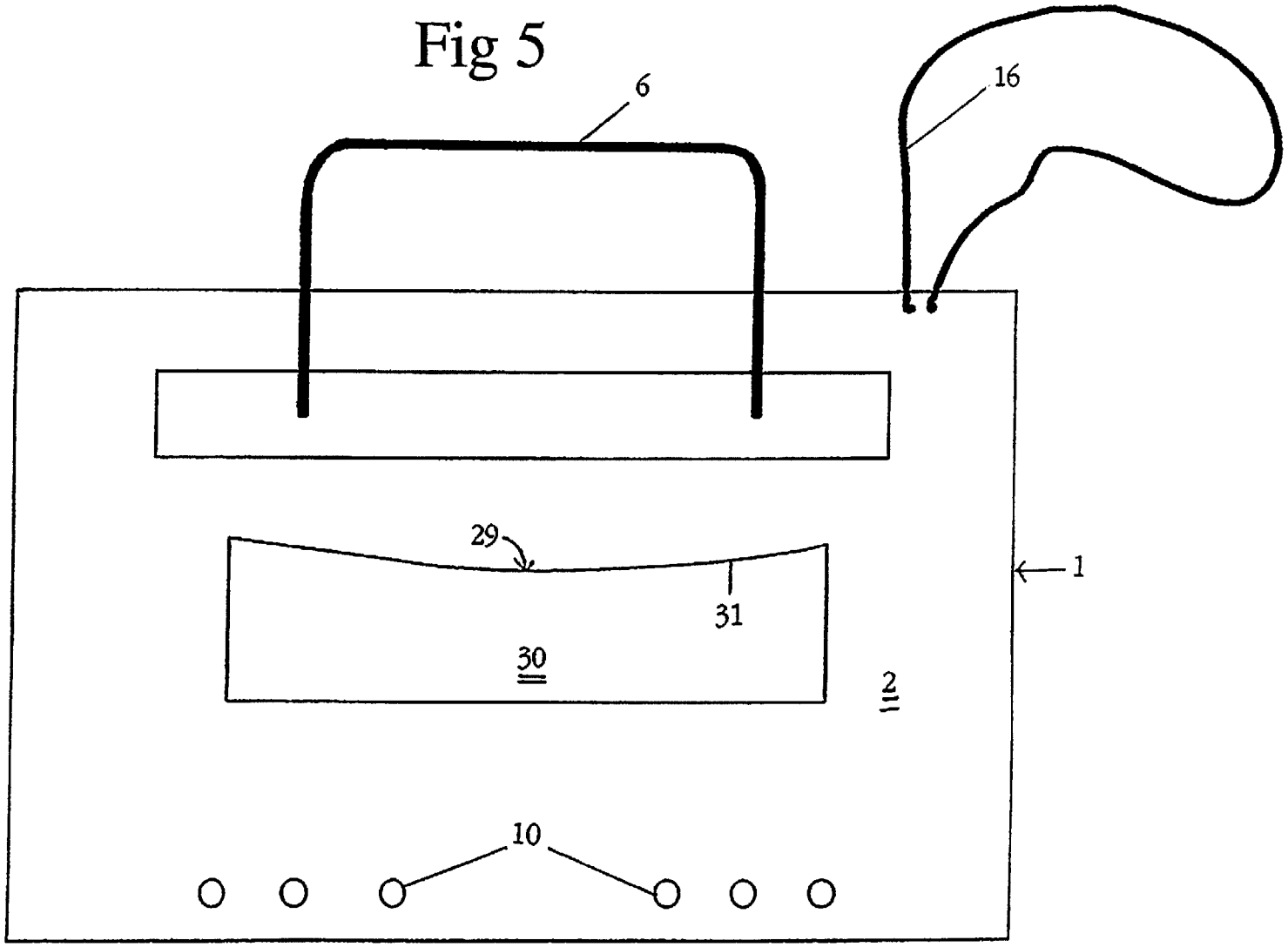
FIG. 5 is a side view of the notebook carrying device having a pocket formed on the side of one of the panels.

FIG. 5 illustrates a second pocket 29 formed on the surface of one of the panels 2/4. A sheet material 30 is attached to one of the panels with an open top end 31 to form the pocket 29.

The panels 2/4 are ideally made or die cut of flexible or rigid materials such as paper, reinforced fabric, plastic, or cardboard. The handles 6 are made of the same material as the panels 2/4, leather, string, rope, or braided or folded paper. The handle should be flexible enough to fold inside of notebook 20 when the carrying device 1 is not being used. The expandable band is ideally made of rubber or other elastic materials, fabric, hook and fabric connectors (tradename: Velcro), or plastic.

Figure 6:
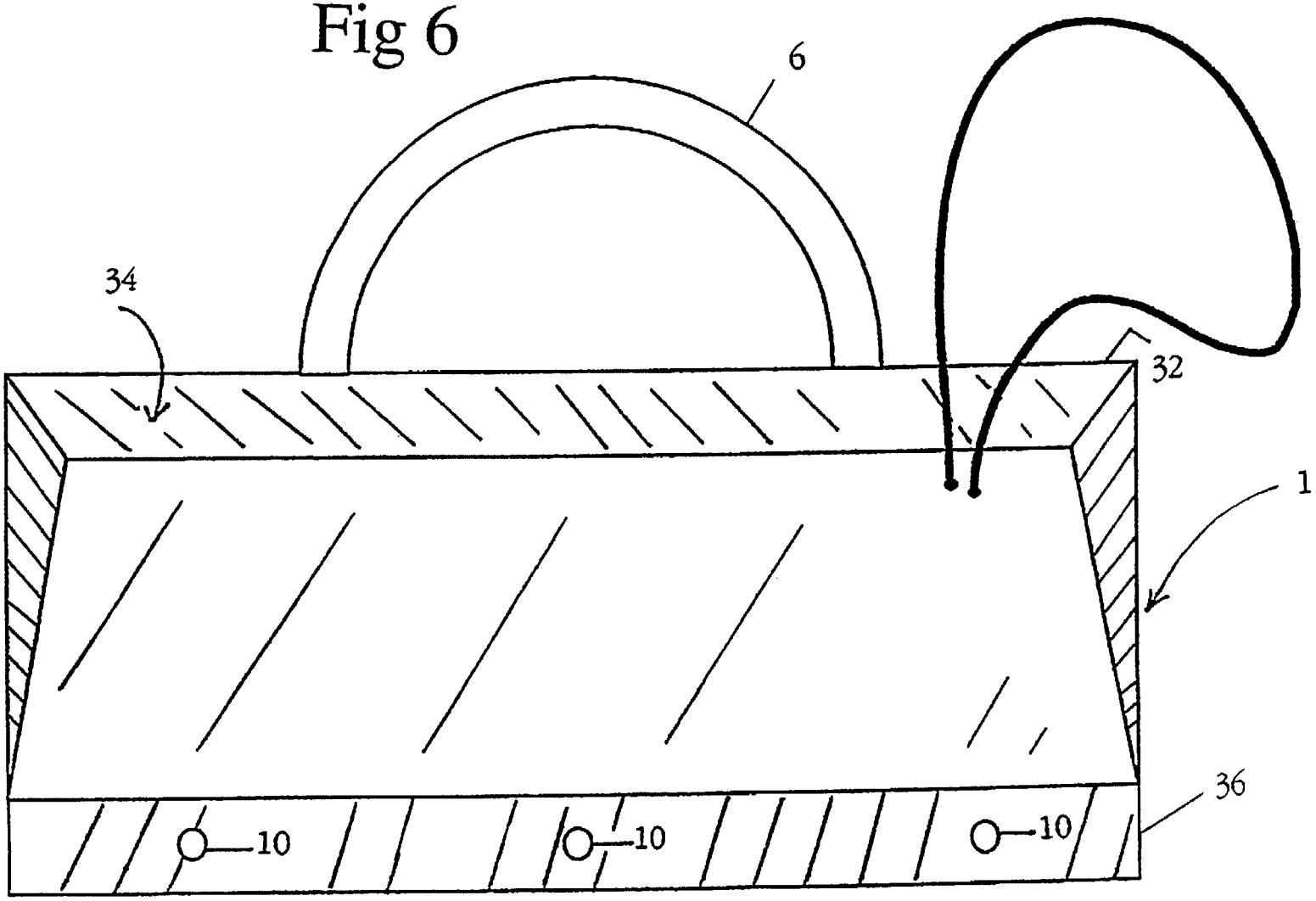
FIG. 6 is a side view of an alternate embodiment of the notebook carrying device which utilized a pouch.

A second embodiment of the present invention is illustrated in FIG. 6. A pouch 32, made of plastic, paper or fabric, has an open top end 34 and a bottom edge 36 with holes 10 formed therein. A handle 6 extends from the top end 34, and an elastic band 16 is attached to pouch 32 to form an expandable loop that keeps the covers 22 closed together while carrying the notebook by the handle 6. A flap or other means (not shown) for closing the open top end 34 can be added to keep items secured in the pouch 32 from falling out.

Pouch 32 not only provides a convenient storage location within the notebook 20, but also provides a convenient means for carrying the notebook 20. The handle 6 extends beyond the covers 22 for carrying the notebook in its closed position.

The carrying device 1, as illustrated in the above embodiments, allows the user to carry the notebook 20 by merely grasping handle(s) 6. This potentially gives the user better balance when walking on a slick surface or in dark areas. Multiple notebooks can easily be carried in one hand without the risk of them slipping from the user's grasp. This device is ideal for students who have to carry many books, travellers and shoppers who need to carry other items along with their notebooks, the infirm or aged who need a simple handle means to carry their notebooks, and handicapped persons who must use their hands to also grasp crutches, walkers and canes.

It is to be understood that the present invention is not limited to the embodiments described above and illustrated herein, but encompasses any and all variations falling within the scope of the appended claims.

What is claimed is:

1. A notebook carrier device, comprising:

a first and a second panel foldably connected at a fold line, a first and a second set of holes formed adjacent said fold line on said first and second panels respectively, said first and second sets of holes oppose each other when said first and second panels are folded together about said fold line;

a first handle extending from said first panel beyond an edge of said first panel.

2. The notebook carrier device of claim 1, further comprising a second handle extending from said second panel.

3. The notebook carrier device of claim 2, further comprising:

a band attached to at least one of said panels to form a loop.

4. The notebook carrier device of claim 2, further comprising:

sheet material attached to one of said panels to form a pocket thereon.

5. The notebook carrier device of claim 2, wherein said handles are integrally formed with said first and second panels.

6. The notebook carrier device of claim 2, wherein said handles are attached to said first and second panels with an adhesive.

7. A notebook carrier device for carrying a notebook that includes front and back covers and rings that secure pages therein, the carrier device comprising:

a first and a second panel foldably connected at a fold line, a first and a second set of holes formed adjacent said fold line on said first and second panels respectively, said first and second sets of holes positioned to oppose each other when said first and second panels are folded together about said fold line for engaging the rings of the notebook;

a first handle extending from said first panel beyond the covers of the notebook.

8. The notebook carrier device of claim 7, further comprising a second handle extending from said second panel beyond the covers of the notebook.

9. The notebook carrier device of claim 8, further comprising:

a band attached to at least one of said panels to form a loop that engages the covers of the notebook to maintain the covers in a closed position.

10. The notebook carrier device of claim 8, further comprising:

sheet material attached to one of said panels to form a pocket thereon.

11. The notebook carrier device of claim 8, wherein said handles are integrally formed with said first and second panels.

12. The notebook carrier device of claim 8, wherein said handles are attached to said first and second panels with an adhesive.

13. A notebook carrier device for carrying a notebook that includes front and back covers and rings that secure pages therein, the carrier device comprising:

a pouch with a top opening and a bottom edge;

a plurality of holes formed in said pouch adjacent said bottom edge, said plurality of holes positioned to engage the rings of the notebook;

a handle extending from said pouch beyond the covers of the notebook.

14. The notebook carrier device of claim 13, further comprising:

a band attached to said pouch to form a loop that engages the covers of the notebook to maintain the covers in a closed position.

15. The notebook carrier device of claim 13, wherein said handle is integrally formed with said pouch.

16. The notebook carrier device of claim 13, wherein said handle is attached to said pouch with an adhesive.

* * * * *